US009875715B2

(12) United States Patent
Cho

(10) Patent No.: US 9,875,715 B2
(45) Date of Patent: Jan. 23, 2018

(54) DISPLAY APPARATUS AND METHOD OF DRIVING DISPLAY PANEL USING THE SAME

(71) Applicant: Samsung Display Co., Ltd., Yongin-si, Gyeonggi-Do (KR)

(72) Inventor: Jae-Hyun Cho, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 249 days.

(21) Appl. No.: 14/814,166

(22) Filed: Jul. 30, 2015

(65) Prior Publication Data

US 2016/0189689 A1 Jun. 30, 2016

(30) Foreign Application Priority Data

Dec. 26, 2014 (KR) ..... 10-2014-0190951

(51) Int. Cl.

| | |
|---|---|
| ***G09G 5/393*** | (2006.01) |
| ***G09G 5/395*** | (2006.01) |
| ***G09G 3/36*** | (2006.01) |

(52) U.S. Cl.

CPC ..... *G09G 3/3688* (2013.01); *G09G 3/3618* (2013.01); *G09G 3/3648* (2013.01); *G09G 2310/027* (2013.01); *G09G 2320/0295* (2013.01); *G09G 2320/103* (2013.01); *G09G 2330/021* (2013.01); *G09G 2340/16* (2013.01); *G09G 2360/18* (2013.01)

(58) Field of Classification Search

CPC .. G09G 3/3688; G09G 3/3266; G09G 3/3275; G09G 3/3677; G09G 3/3614; G09G 3/3611; G09G 2310/0278; G09G 5/393; G09G 5/395

See application file for complete search history.

(56) References Cited

U.S. PATENT DOCUMENTS

| | | | | |
|---|---|---|---|---|
| 8,866,710 | B2 | 10/2014 | Teranishi et al. | |
| 8,922,544 | B2 | 12/2014 | Chaji et al. | |
| 2006/0214898 | A1* | 9/2006 | Woo | G09G 3/3688 345/90 |
| 2008/0024473 | A1* | 1/2008 | Hsu | G09G 3/3648 345/204 |
| 2010/0066720 | A1 | 3/2010 | Kawabe | |
| 2010/0188365 | A1* | 7/2010 | Tamaki | G06F 3/0412 345/174 |

FOREIGN PATENT DOCUMENTS

| | | | |
|---|---|---|---|
| JP | 1998-222136 | A | 8/1998 |
| JP | 2010-145663 | A | 7/2010 |

* cited by examiner

*Primary Examiner* — Jennifer Mehmood
*Assistant Examiner* — Sardis F Azongha
(74) *Attorney, Agent, or Firm* — H.C. Park & Associates, PLC

(57) ABSTRACT

A display apparatus includes a display panel, a gate driver and a data driver. The display panel includes a plurality of gate lines, a plurality of data lines and a plurality of pixels connected to the gate lines and the data lines. The display panel displays an image. The gate driver is configured to output a gate signal to the gate line. The data driver is configured to selectively operate one of outputting a data voltage to the data line and reading the data voltage stored in the pixel through the data line.

19 Claims, 9 Drawing Sheets

DISPLAY APPARATUS AND METHOD OF DRIVING DISPLAY PANEL USING THE SAME

CLAIM OF PRIORITY

This application makes reference to, incorporates the same herein, and claims all benefits accruing under 35 U.S.C. § 119 from an application earlier filed in the Korean Intellectual Property Office on 26 Dec. 2014 and there duly assigned Serial No. 10-2014-0190951.

BACKGROUND OF THE INVENTION

Field of the Invention

Exemplary embodiments of the present inventive concept relate to a display apparatus and a method of driving a display panel using the display apparatus. More particularly, exemplary embodiments of the present inventive concept relate to a display apparatus capable of reading a pixel voltage in a display panel and a method of driving a display panel using the display apparatus.

Description of the Related Art

A display apparatus includes a display panel and a display panel driver. The display panel includes a gate line and a data line. The display panel driver includes a timing controller, a gate driver and a data driver.

The data driver outputs a data voltage to the data line. Pixels in the display panel represent luminance based on the data voltage.

To repetitively display the same image on the display panel or to compensate the image on the display panel using a previous frame data and a present frame data, an additional memory may be required.

Due to the additional memory, a manufacturing cost of the display apparatus may increase. In addition, when the timing controller continuously receives input image data to display the same repetitive image, the power may be unnecessarily consumed.

The above information disclosed in this Background section is only for enhancement of understanding of the background of the inventive concept, and, therefore, it may contain information that does not form the prior art that is already known in this country to a person of ordinary skill in the art.

SUMMARY OF THE INVENTION

Exemplary embodiments of the present inventive concept provide a display apparatus capable of reducing a manufacturing cost of the display apparatus.

Exemplary embodiments of the present inventive concept also provide a method of driving a display panel using the display apparatus.

In an exemplary embodiment of a display apparatus according to the present inventive concept, the display apparatus includes a display panel, a gate driver and a data driver. The display panel includes a plurality of gate lines, a plurality of data lines and a plurality of pixels connected to the gate lines and the data lines. The display panel displays an image. The gate driver is configured to output a gate signal to the gate line. The data driver is configured to selectively operate one of outputting a data voltage to the data line and reading the data voltage stored in the pixel through the data line.

In an exemplary embodiment, the data driver may include a buffer part configured to output the data voltage to the data line, a read part configured to read the data voltage stored in the pixel through the data line and a selecting part configured to be selectively connected to the buffer part and the read part.

In an exemplary embodiment, the read part may include a sampling part configured to sample the data voltage stored in the pixel and a storing part configured to store the sampled data voltage.

In an exemplary embodiment, the sampling part may include a read in switch connected to the data line, an amplifier including a first input electrode connected to the read in switch, a second input electrode to which a reference voltage is applied and an output electrode, a hold capacitor including a first end connected to the first input electrode of the amplifier and a second end connected to the output electrode of the amplifier and a reset switch connected between the first end of the hold capacitor and the second end of the hold capacitor.

In an exemplary embodiment, the storing part may include a first switch connected between the output electrode of the amplifier and a first node, a second switch connected between the first node and an output node of the read part, a first storing capacitor including a first end connected to the first node and a second end connected to a ground, a third switch connected to the output electrode of the amplifier and a second node, a fourth switch connected between the second node and the output node of the read part and a second storing capacitor including a first end connected to the second node and a second end connected to the ground.

In an exemplary embodiment, the first switch and the fourth switch may be substantially simultaneously turned on. The second switch and the third switch may be substantially simultaneously turned on.

In an exemplary embodiment, when the first switch and the fourth switch are turned on, the second switch and the third switch may be turned off. When the first switch and the fourth switch are turned off, the second switch and the third switch may be turned on.

In an exemplary embodiment, an output voltage of the read part may be inputted to the buffer part.

In an exemplary embodiment, when a data signal is not inputted to the data driver, the data driver may rewrite the data voltage read from the pixel to the pixel.

In an exemplary embodiment, the data driver may further include an overdrive part configured to receive a present frame data signal from a timing controller and a previous frame data voltage from the read part and adjust the present frame data signal.

In an exemplary embodiment, the overdrive part may include an analog to digital converter part configured to convert the previous frame data voltage into a previous frame data signal having a digital type and an output part configured to compare the present frame data signal and the previous frame data signal and generate a present frame overdriving signal.

In an exemplary embodiment, a number of the read part in the data driver may be substantially the same as a number of the data lines on the display panel.

In an exemplary embodiment, the gate driver may be configured to output a read gate pulse for reading the data voltage of the pixel connected to an N-th gate line and an output gate pulse for outputting the data voltage of the pixel connected to the N-th gate line. N is a positive integer.

In an exemplary embodiment, the output gate pulse may be delayed by K gate lines from the read gate pulse. K is a positive integer.

In an exemplary embodiment, a pulse width of the gate signal may be defined as (frame duration)/(2*number of the gate lines).

In an exemplary embodiment of a method of driving a display panel according to the present inventive concept, the method includes outputting a gate signal to a gate line of the display panel using a gate driver and selectively operating one of outputting a data voltage to a data line of the display panel and reading the data voltage stored in a pixel through the data line using a data driver.

In an exemplary embodiment, the data driver may include a buffer part configured to output the data voltage to the data line, a read part configured to read the data voltage stored in the pixel through the data line and a selecting part configured to be selectively connected to the buffer part and the read part.

In an exemplary embodiment, the read part may include a sampling part configured to sample the data voltage stored in the pixel and a storing part configured to store the sampled data voltage.

In an exemplary embodiment, when a data signal is not inputted to the data driver from a timing controller, the data voltage read from the pixel may be rewritten to the pixel.

In an exemplary embodiment, the outputting the data voltage to the data line may include receiving a present frame data signal from a timing controller, receiving a previous frame data voltage from the read part and generating a prevent frame overdriving signal by adjusting the present frame data signal based on the present frame data signal and the previous frame data voltage.

According to the display apparatus and the method of driving the display panel using the display apparatus, the data driver may directly read the data voltage from the pixel of the display panel so that the display apparatus does not include an additional frame memory. Thus, a manufacturing cost of the display apparatus may be reduced. In addition, to repetitively display the same image on the display panel, the read data voltage may be refreshed without receiving an image source from an application processor or the timing controller. Thus, a power consumption of the display apparatus may be reduced.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTIVE CONCEPT

Hereinafter, the present inventive concept will be explained in detail with reference to the accompanying drawings.

Figure 1:
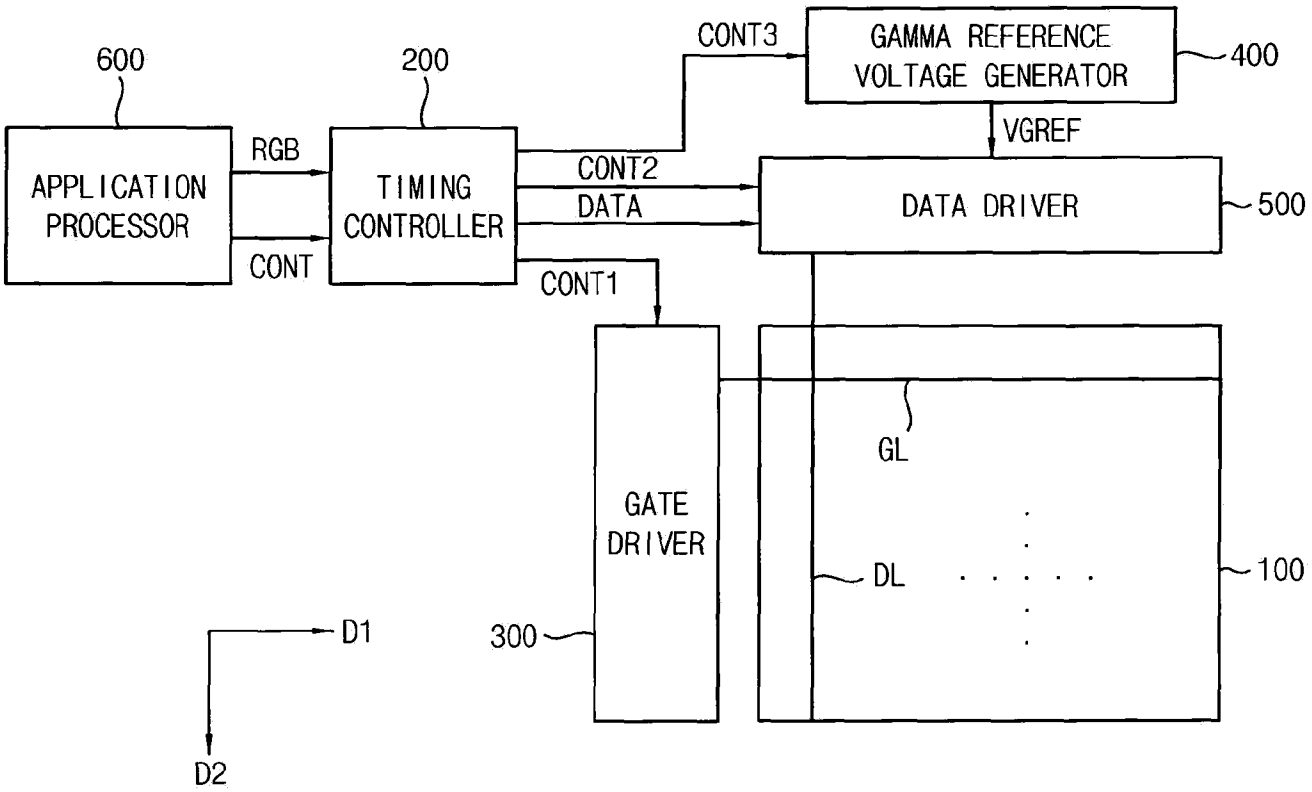
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100, a display panel driver and an application processor 600. The display panel driver includes a timing controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

Each pixel includes a switching element (not shown), a liquid crystal capacitor (not shown) and a storage capacitor (not shown). The liquid crystal capacitor and the storage capacitor are electrically connected to the switching element. The pixels may be disposed in a matrix form.

The timing controller 200 receives input image data RGB and an input control signal CONT from the application processor 600. The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or may be connected to the display panel 100 as a tape carrier package (TCP) type. Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the data driver 500. Alternatively, the gamma reference voltage generator 400 may be disposed in the timing controller 200.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may be directly mounted on the display panel 100, or be connected to the display panel 100 in a TCP type. Alternatively, the data driver 500 may be integrated on the peripheral region of the display panel 100.

A structure and an operation of the data driver 500 are explained referring to FIGS. 2, 3, 4A and 4B in detail.

The application processor 600 decodes an input image and converts the decoded input image into the input image data RGB. The application processor 600 outputs the input image data RGB to the timing controller 200. The application processor 600 outputs the input control signal CONT to the timing controller 200.

For example, the application processor 600 may be a TV (television) set board.

Figure 2:
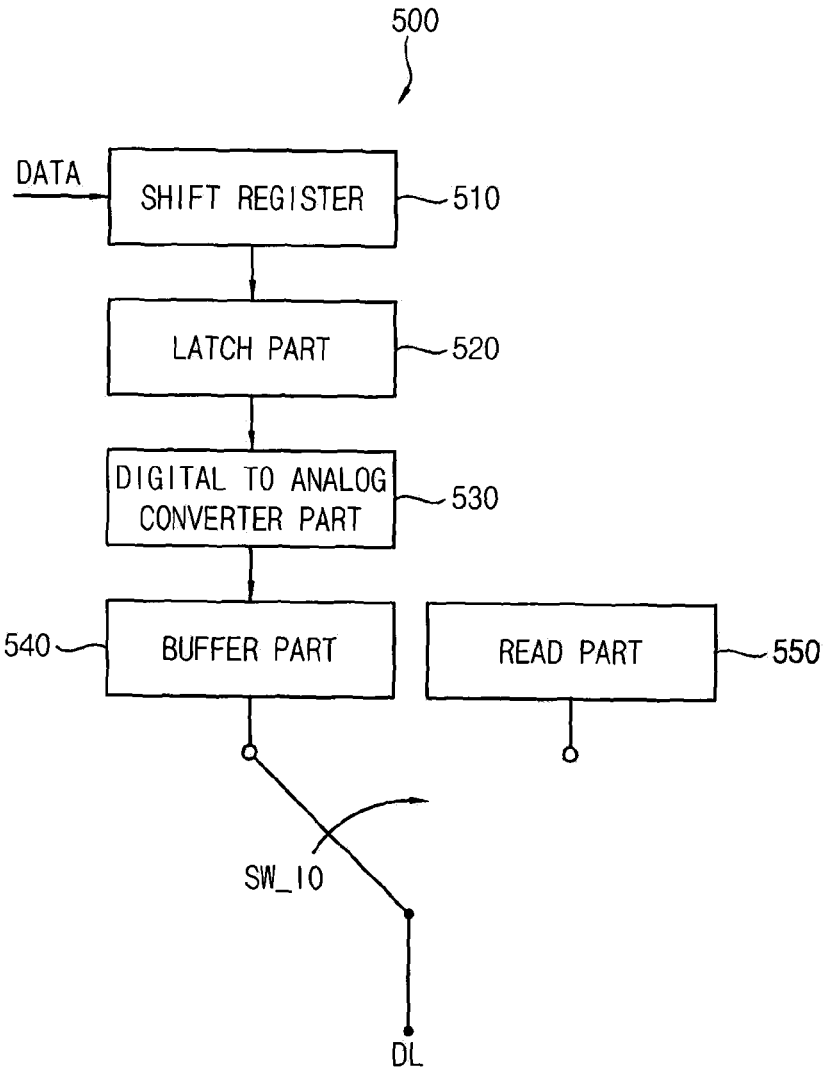
FIG. 2 is a block diagram illustrating a data driver of FIG. 1.
Figure 3:
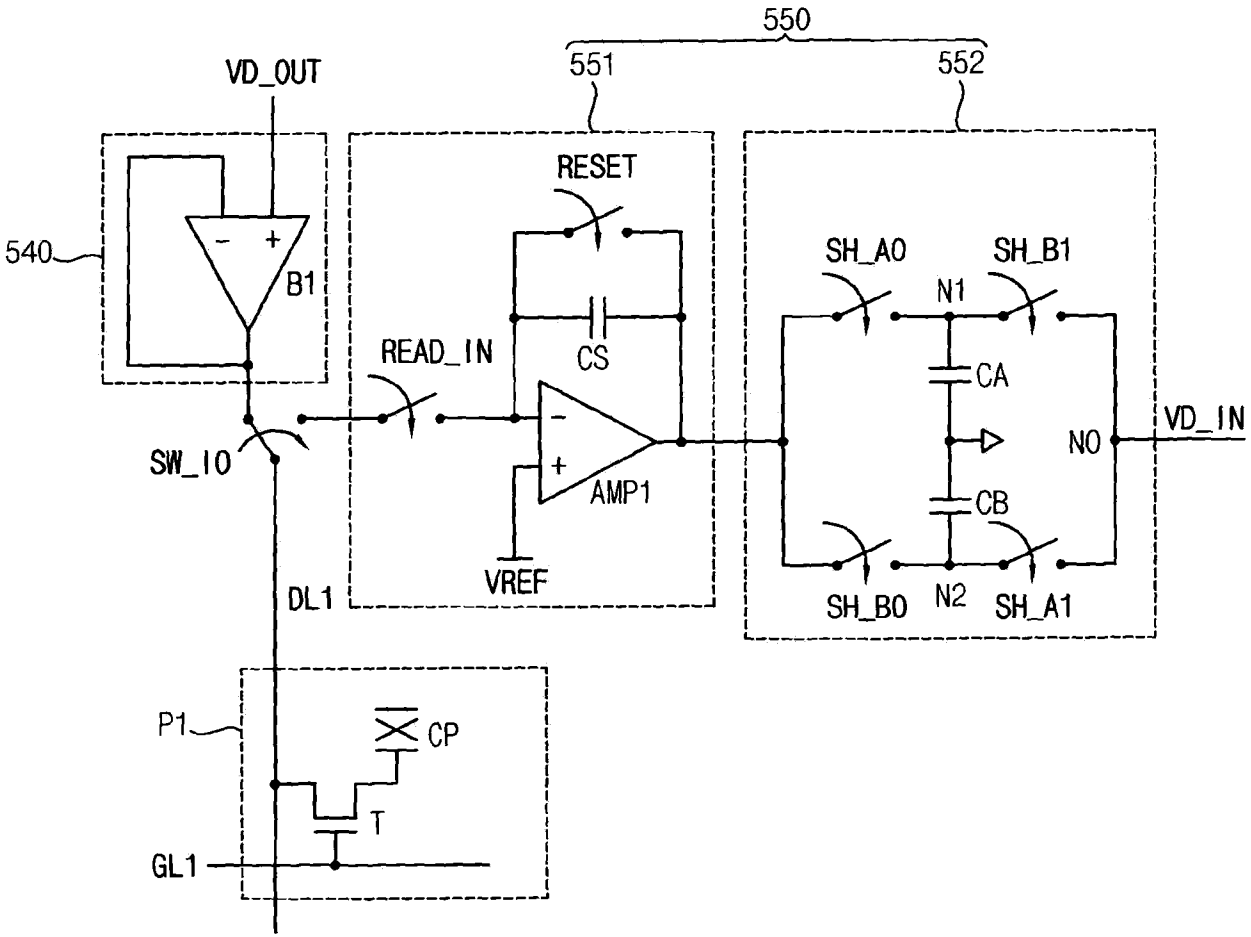
FIG. 3 is a circuit diagram illustrating a read part of FIG. 2.
Figure 4A:
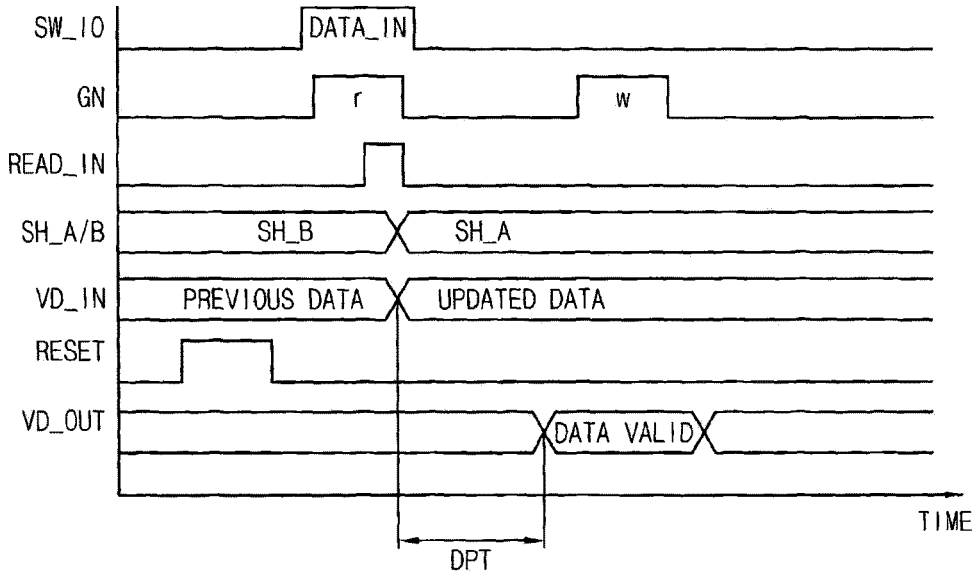
FIGS. 4A and 4B are timing diagrams illustrating input signals output signals and control signals of the data driver of FIG. 1.
Figure 4B:
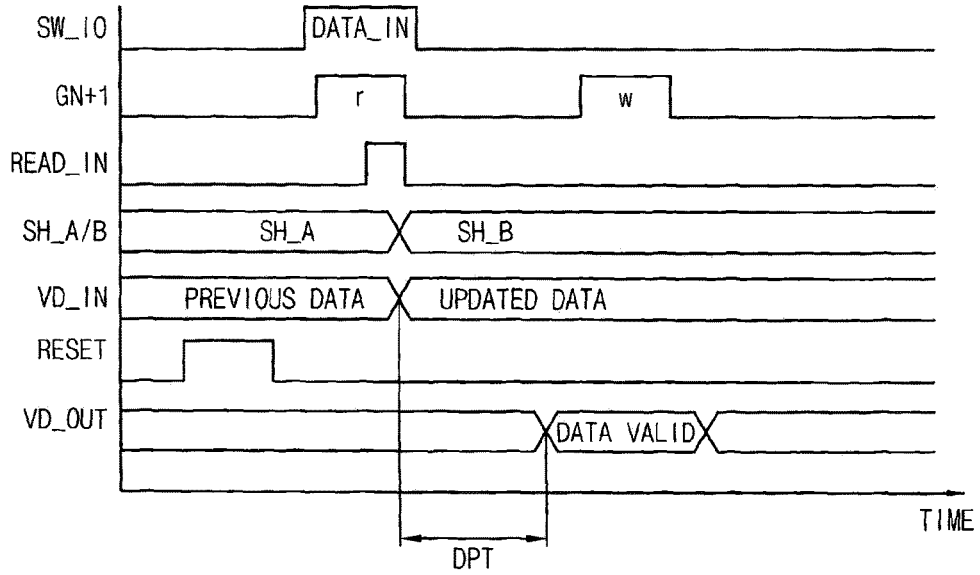
Figure 5A:
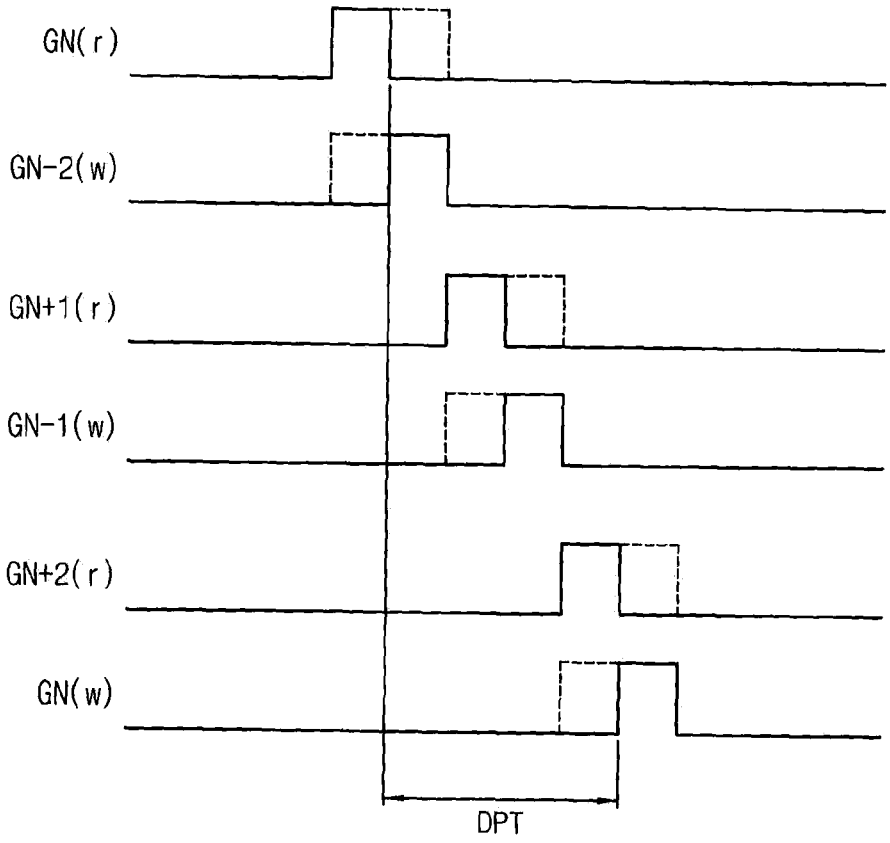
FIGS. 5A and 5B are timing diagrams illustrating output signals of a gate driver of FIG. 1.
Figure 5B:
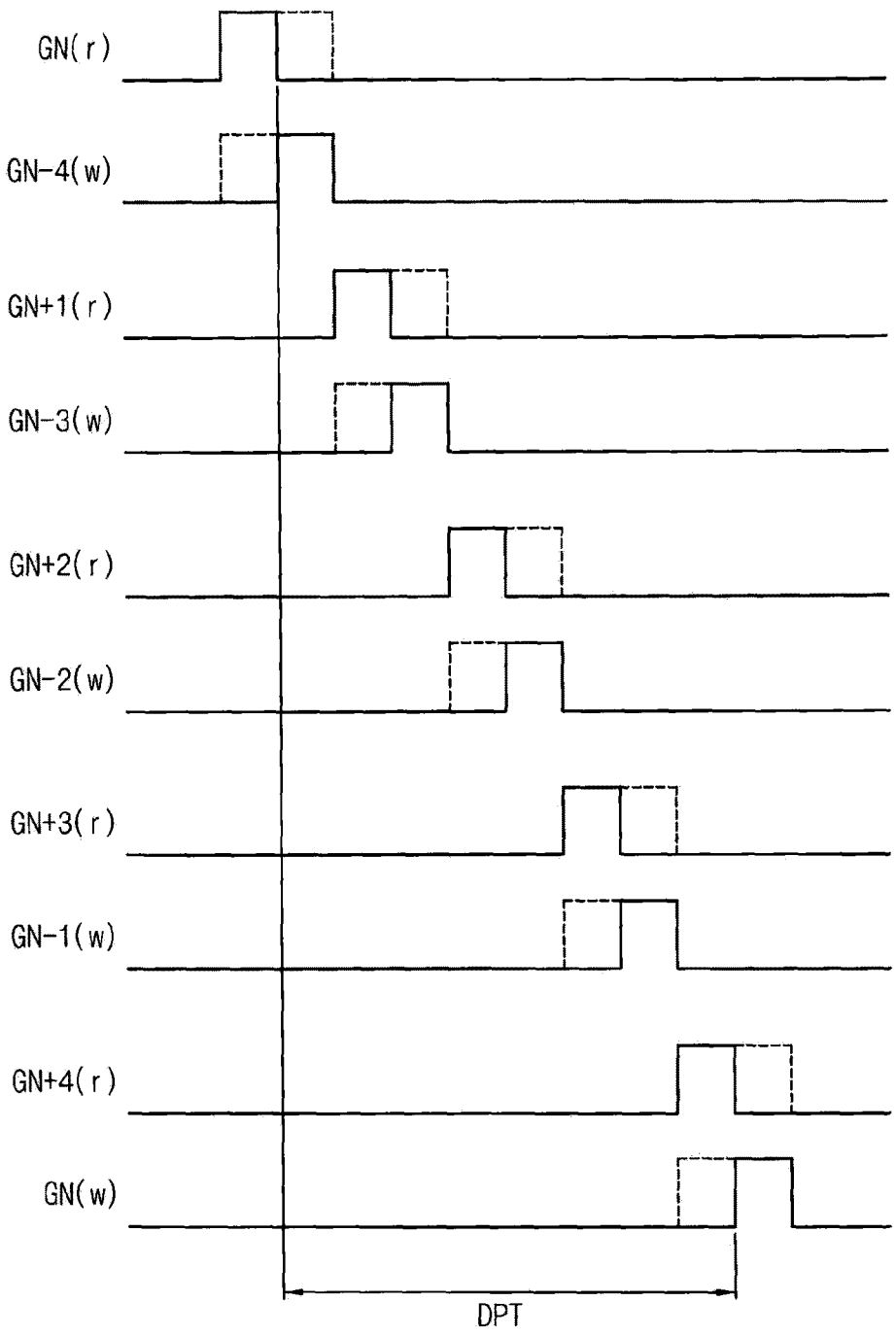

FIG. 2 is a block diagram illustrating the data driver 500 of FIG. 1. FIG. 3 is a circuit diagram illustrating a read part 550 of FIG. 2. FIGS. 4A and 4B are timing diagrams illustrating input signals output signals and control signals of the data driver 500 of FIG. 1. FIGS. 5A and 5B are timing diagrams illustrating output signals of the gate driver 300 of FIG. 1.

Referring to FIGS. 1 and 2, the data driver 500 outputs the data voltage to the data line DL. In addition, the data driver 500 reads the data voltage stored in the pixel of the display panel 100 through the data line DL. The data driver 500 selectively operates one of outputting the data voltage and reading the data voltage.

The data driver 500 includes a buffer part 540 outputting the data voltage to the data line DL, the read part 550 reading the data voltage stored in the pixel through the data line DL and a selecting part SW_IO selectively connecting one of the buffer part 540 and the read part 550 to the data line DL.

For example, the selecting part SW_IO may be a switch. Alternatively, the selecting part SW_IO may include a multiplexer.

The data driver 500 may further include a shift register 510, a latch part 520, a digital to analog converter ("DAC") part 530.

The shift register 510 receives the data signal DATA from the timing controller 200. The shift register 510 converts the data signal DATA in a serial type. The shift register 510 outputs a latch pulse to the latch part 520.

The latch part 520 temporally stores the data signal DATA and outputs the data signal DATA to the digital to analog converter part 530.

The digital to analog converter part 530 generates the data voltages having an analogue type based on the data signal DATA having a digital type and the gamma reference voltages VGREF. The digital to analog converter part 530 outputs the data voltages to the buffer part 540.

The buffer part 540 compensates the data voltages to have a uniform level, and outputs the data voltages to the data lines DL.

When the switch of the selecting part SW_IO is connected to a buffer B1 of the buffer part 540, the data driver 500 outputs the data voltage to the data line DL1.

When the switch of the selecting part SW_IO is connected to the read part 550, the data driver 500 reads the data voltage stored in the liquid crystal capacitor CP of the pixel P1 through the data line DL1.

The read part 550 includes a sampling part 551 which samples the data voltage stored in the pixel and a storing part 552 which stores the sampled data voltage.

The number of the read parts 550 in the data driver 500 may be the same as the number of the data lines DL on the display panel 100. The number of the read parts 550 in the data driver 500 may be the same as the number of the buffers of the buffer parts 540 in the data driver 500. A single read part 550 of the data driver may sequentially read the data voltages stored in the pixels in a single pixel column in response to the gate signals. The plurality of data voltages in the single pixel column are read by the single read part 550 and processed in a pipelining method.

The sampling part 551 reads a level of the data voltage stored in the pixel in a sample and hold method.

The sampling part 551 may include a read in switch READ_IN connected to the data line DL1, an amplifier AMP1 including a first input electrode, a second input electrode and an output electrode, a hold capacitor CS including a first end connected to the first input electrode of the amplifier AMP1 and a second end connected to the output electrode of the amplifier AMP1 and a reset switch RESET connected between the first end of the hold capacitor CS and the second end of the hold capacitor CS. The first input electrode of the amplifier AMP1 is connected to the read in switch READ_IN. A reference voltage VREF is applied to the second input electrode of the amplifier AMP1.

The storing part 552 may include a first switch SH_A0 connected between the output electrode of the amplifier AMP1 and a first node N1, a second switch SH_B1 connected between the first node N1 and an output node NO of the read part 550, a first storing capacitor CA including a first end connected to the first node N1 and a second end connected to a ground, a third switch SH_B0 connected between the output electrode of the amplifier AMP1 and the second node N2, a fourth switch SH_A1 connected between the second node N2 and the output node NO of the read part 550 and a second storing capacitor CB including a first end connected to the second node N2 and a second end connected to the ground.

The first switch SH_A0 and the fourth switch SH_A1 are substantially simultaneously turned on. The second switch SH_B1 and the third switch SH_B0 are substantially simultaneously turned on.

For example, when the first switch SH_A0 and the fourth switch SH_A1 are turned on, the second switch SH_B1 and the third switch SH_B0 are turned off. When the first switch SH_A0 and the fourth switch SH_A1 are turned off, the second switch SH_B1 and the third switch SH_B0 are turned on.

FIG. 4A illustrates steps reading (r) the data voltage from the pixels connected to an N-th gate line and outputting (w) the data voltages to the pixels connected to the N-th gate line.

In a read mode DATA_IN of the data voltage, the data line DL1 is connected to the read in switch READ_IN of the read part 550 by the selecting part SW_IO.

In the read mode DATA_IN of the data voltage, a read gate pulse GN(r) of the N-th gate line is turned on.

When the read in switch READ_IN is turned on, the data voltage of the pixel connected to the N-th gate line is charged in the hold capacitor CS. Quantity of the data voltage stored in the hold capacitor CS may be determined by the turn-on time of the read in switch READ_IN.

For example, the turn-on time of the read in switch READ_IN may be shorter than a duration when the selecting part SW_IO connects the data line DL1 to the read part 550.

Before the read in switch READ_IN is turned on, the reset switch may be turned on. When the reset switch is turned on, the first and second input electrodes of the amplifier AMP1 and the output electrode of the amplifier AMP1 are reset to the reference voltage VREF.

When the read in switch READ_IN is turned on, the data voltage of the pixel connected to the N-th gate line is charged in the hold capacitor CS. When the read in switch READ_IN is turned off, the sampled data voltage is transferred to the storing capacitor of the storing part 552.

In FIG. 4A, when the read in switch READ_IN is turned off, the first switch SW_A0 and the fourth switch SW_A1 of the storing part 552 are turned on and the second switch SW_B1 and the third switch SW_B0 of the storing part 552 are turned off.

When the read in switch READ_IN is turned off and the first switch SW_A0 and the fourth switch SW_A1 of the storing part 552 are turned on, the sampled data voltage UPDATAED_DATA is stored in the first storing capacitor CA via the first node N1.

At this time, the previous data voltage PREVIOUS_DATA which stored in the second storing capacitor CB is outputted to the output node NO of the read part 550.

When a data processing time DPT passes, the data voltage UPDATAED_DATA stored in the first storing capacitor CA may become valid.

When the data voltage UPDATAED_DATA stored in the first storing capacitor CA becomes valid, an output gate pulse GN(w) of the N-th gate line is turned on so that the data voltage DATA VALID may be outputted to the display panel 100.

FIG. 4B illustrates steps reading (r) the data voltage from the pixels connected to an (N+1)-th gate line adjacent to the N-th gate line and outputting (w) the data voltages to the pixels connected to the (N+1)-th gate line.

In FIG. 4A, the signal SH_A/B is changed from SH_B to SH_A so that the first switch SW_A0 and the fourth switch SW_A1 of the storing part 552 are turned on when the read in switch READ_IN is turned off. In FIG. 4B, the signal SH_A/B is changed from SH_A to SH_B so that the second switch SW_B1 and the third switch SW_B0 of the storing part 552 are turned on when the read in switch READ_IN is turned off.

The timings of the control signals in FIG. 4B are substantially the same as the timings of the control signals in FIG. 4A except for the signal SH_A/B. The timing diagrams in FIG. 4B are time-shifted from the timing diagrams in FIG. 4A. Some time passes from the timing of FIG. 4A, the timing of FIG. 4B processes. The timing relationship between FIGS. 4A and 4B is further explained referring to FIGS. 5A and 5B.

In the read mode DATA_IN of the data voltage, the data line DL1 is connected to the read in switch READ_IN of the read part 550 by the selecting part SW_IO.

In the read mode DATA_IN of the data voltage, a read gate pulse GN+1(r) of the (N+1)-th gate line is turned on.

When the read in switch READ_IN is turned on, the data voltage of the pixel connected to the (N+1)-th gate line is charged in the hold capacitor CS. When the read in switch READ_IN is turned off, the sampled data voltage is transferred to the storing capacitor of the storing part 552.

In FIG. 4B, when the read in switch READ_IN is turned off, the first switch SW_A0 and the fourth switch SW_A1 of the storing part 552 are turned off and the second switch SW_B1 and the third switch SW_B0 of the storing part 552 are turned on.

When the read in switch READ_IN is turned off and the second switch SW_B1 and the third switch SW_B0 of the storing part 552 are turned on, the sampled data voltage UPDATAED_DATA is stored in the second storing capacitor CB via the second node N2.

At this time, the previous data voltage PREVIOUS_DATA which stored in the first storing capacitor CA is outputted to the output node NO of the read part 550.

When the data processing time DPT passes, the data voltage UPDATAED_DATA stored in the second storing capacitor CB may become valid.

When the data voltage UPDATAED_DATA stored in the second storing capacitor CB becomes valid, an output gate pulse GN+1(w) of the (N+1)-th gate line is turned on so that the data voltage DATA VALID may be outputted to the display panel 100.

As explained above, the first storing capacitor CA and the second storing capacitor CB of the storing part 552 alternately store and output the data voltage connected to the pixels connected to adjacent gate lines.

The gate driver 300 outputs the read gate pulse GN(r) of the N-th gate line for reading the data voltage of the pixel connected to the N-th gate line and the output gate pulse GN(w) of the N-th gate line for outputting the data voltage to the pixel connected to the N-th gate line.

Similarly, the gate driver 300 outputs the read gate pulse GN+1(r) of the (N+1)-th gate line for reading the data voltage of the pixel connected to the (N+1)-th gate line and the output gate pulse GN+1(w) of the (N+1)-th gate line for outputting the data voltage to the pixel connected to the (N+1)-th gate line.

For example, the output gate pulse GN(w) may be delayed by K gate lines from the read gate pulse GN(r). For example, the data processing time DPT may be defined duration from a falling edge of the read gate pulse GN(r) to a rising edge of the output gate pulse GN(w).

In FIG. 5A, the output gate pulse GN(w) is delayed by two gate lines from the read gate pulse GN(r).

In FIG. 5B, the output gate pulse GN(w) is delayed by four gate lines from the read gate pulse GN(r).

Generally, a pulse width (illustrated by a dotted line) of the gate signal may be defined as (frame duration)/(number of gate lines). When the display panel 100 is driven in 60 hertz (HZ), the frame duration is 1/60 second.

However, in the present exemplary embodiment, the reading and writing steps are operated during the single frame duration so that the pulse width (illustrated by a full line) of the gate signal is defined as (frame duration)/(2*number of gate lines).

Figure 6:
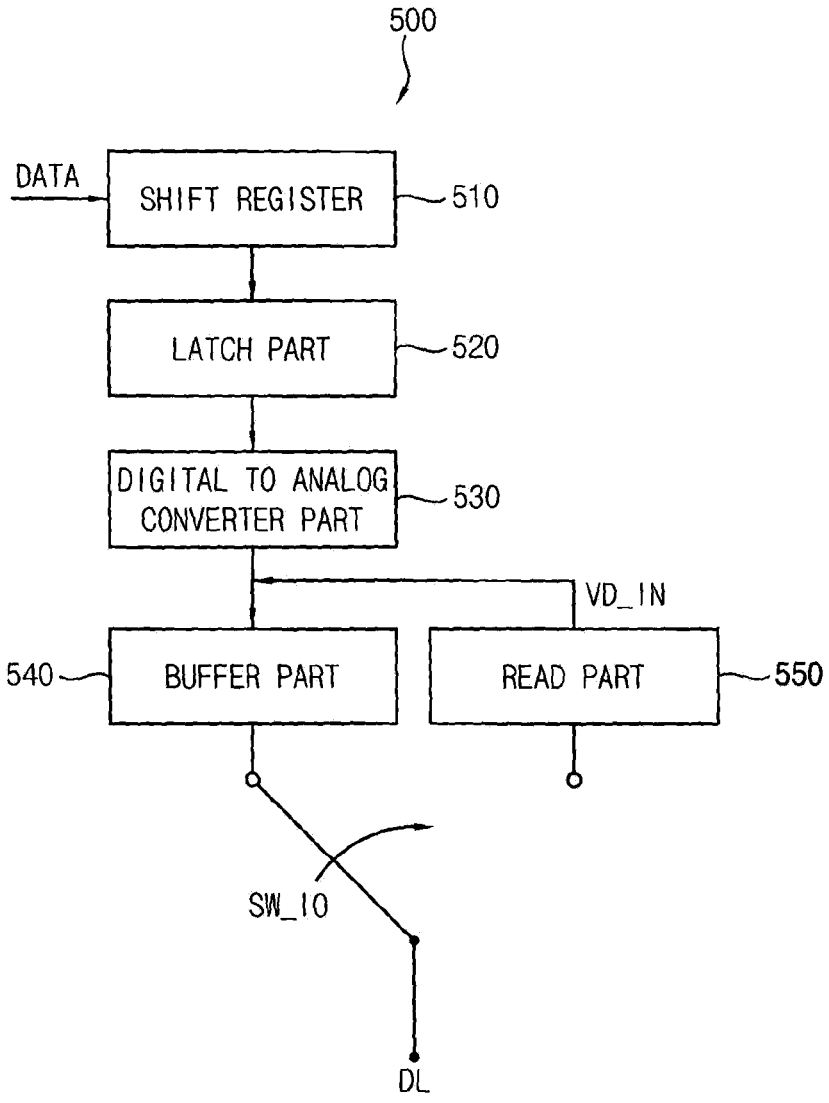
FIG. 6 is a block diagram illustrating an exemplary operation of the data driver of FIG. 1.

FIG. 6 is a block diagram illustrating an exemplary operation of the data driver 500 of FIG. 1.

Referring to FIGS. 1 to 6, the output voltage VD_IN of the read part 550 may be inputted to the buffer part 540. When the data signal DATA is not inputted from the timing controller 200 to the data driver 500, the data driver 500 may rewrite the data voltage VD_IN of the pixel which is read by the read part 500 to the pixel.

For example, when the display panel 100 repetitively displays a same image, the display apparatus may not receive the input image data RGB from the application processor 600 or the data driver 500 may not receive the data signal DATA from the timing controller. Instead, the read part 550 may read the data voltage of the image displayed on the display panel 100 and the buffer part 540 may rewrite the read data voltage to the pixel. Accordingly, unnecessary power consumption of the display apparatus may be reduced.

In addition, when the data signal DATA is not inputted to the data driver 500 due to disorder of the application processor 600 or the timing controller 200, the read part 550 may read the data voltage of the image displayed on the display panel 100 and the buffer part 540 may rewrite the read data voltage to the pixel.

According to the present exemplary embodiment of the present inventive concept, the data driver 500 may directly read the data voltage from the pixels of the display panel 100 so that the display apparatus does not include the additional frame memory. Thus, a manufacturing cost of the display apparatus may be reduced. In addition, when the display panel repetitively displays the same image, the data driver 500 does not receive the image source from the application processor 600 or the timing controller 200. Instead, the data driver 500 may refresh the image on the display panel 100 using the data voltage read from the pixels of the display panel so that the power consumption of the display apparatus may be reduced.

Figure 7:
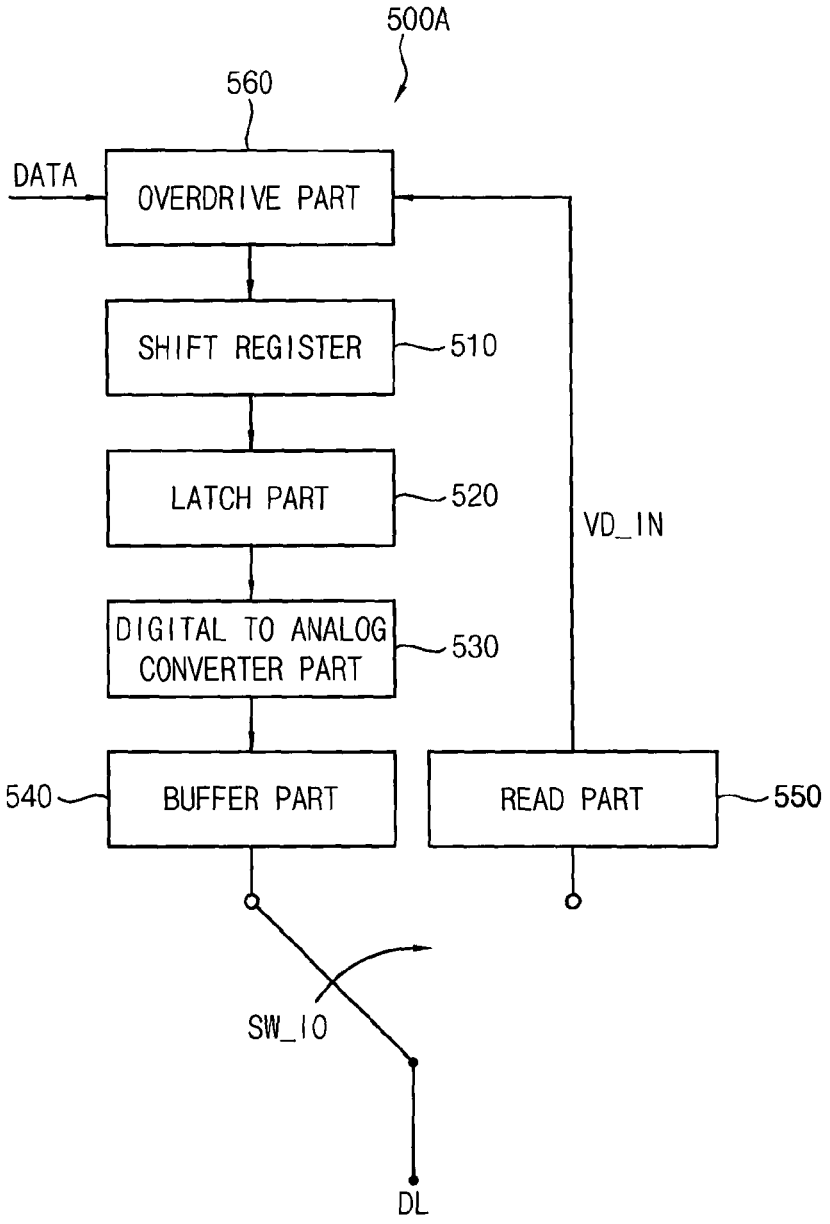
FIG. 7 is a block diagram illustrating an exemplary operation of a data driver according to an exemplary embodiment of the present inventive concept.
Figure 8:
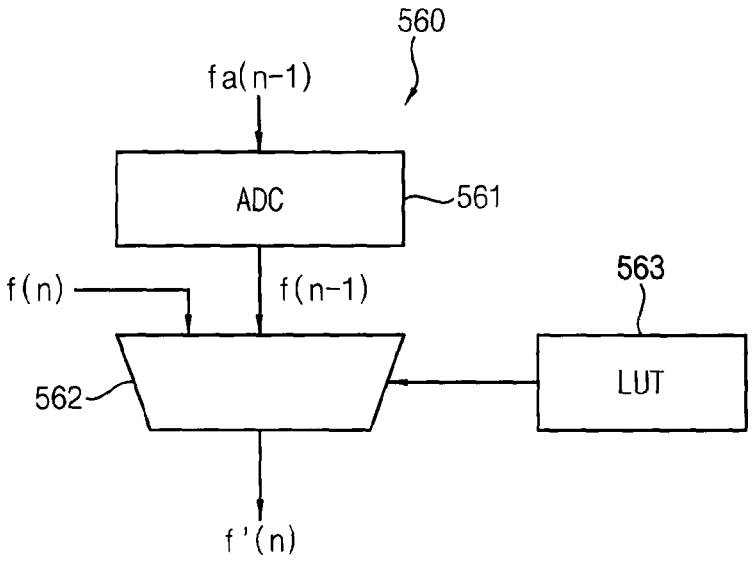
FIG. 8 is a block diagram illustrating an overdrive part of FIG. 7.

FIG. 7 is a block diagram illustrating an exemplary operation of a data driver 500A according to an exemplary embodiment of the present inventive concept. FIG. 8 is a block diagram illustrating an overdrive part 560 of FIG. 7.

The display apparatus and the method of driving the display panel according to the present exemplary embodiment are substantially the same as the display apparatus and the method of driving the display panel of the previous exemplary embodiment explained referring to FIGS. 1 to 6 except for the structure and operation of the data driver 500A. Thus, the same reference numerals will be used to refer to the same or like parts as those described in the previous exemplary embodiment of FIGS. 1 to 6 and any repetitive explanation concerning the above elements will be omitted.

Referring to FIGS. 1, 3 to 5B and 7, the display apparatus includes a display panel 100, a display panel driver and an application processor 600. The display panel driver includes a timing controller 200, a gate driver 300, a gamma reference voltage generator 400 and the data driver 500A.

The data driver 500A outputs the data voltage to the data line DL. In addition, the data driver 500A reads the data voltage stored in the pixel of the display panel 100 through the data line DL. The data driver 500A selectively operates one of outputting the data voltage and reading the data voltage.

The data driver 500A includes a buffer part 540 outputting the data voltage to the data line DL, the read part 550 reading the data voltage stored in the pixel through the data line DL and a selecting part SW_IO selectively connecting one of the buffer part 540 and the read part 550 to the data line DL.

The data driver 500A may further include a shift register 510, a latch part 520, a digital to analog converter ("DAC") part 530.

In the present exemplary embodiment, the data driver 500A may further include an overdrive part 560. The overdrive part 560 receives the present frame data signal DATA from the timing controller 200 and the previous frame data voltage VD_IN from the read part 550 and adjusts the present frame data signal DATA.

The overdrive part 560 includes an analog to digital converter ("ADC") part 561 converting a previous frame data voltage fa(n−1) into a previous frame data signal f(n−1) which has a digital type and an output part 562 comparing the present frame data signal f(n) and the previous frame data signal f(n−1) and generating a present frame overdriving signal f'(n).

The overdrive part 560 may further include a lookup table ("LUT") 563 for generating the present frame overdriving signal f'(n).

For example, when difference between the previous frame data signal f(n−1) and the present frame data signal f(n) is great, the present frame data signal f(n) may be insufficiently charged to the pixel due to lack of a charging time. Thus, the overdrive part 560 adjusts that the present frame overdriving signal f'(n) has a grayscale greater than a grayscale of the present frame data signal f(n) based on the difference between the previous frame data signal f(n−1) and the present frame data signal f(n). Accordingly, the lack of the charging rate of the pixel may be compensated.

According to the present exemplary embodiment of the present inventive concept, the data driver 500A may directly read the data voltage from the pixels of the display panel 100 so that the display apparatus does not include the additional frame memory. Thus, a manufacturing cost of the display apparatus may be reduced. In addition, the lack of the charging rate of the pixel is compensated using the overdriving method so that the display quality of the display panel 100 may be improved.

As explained above, according to the exemplary embodiments, a manufacturing cost of the display apparatus and a power consumption of the display apparatus may be reduced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display apparatus comprising:

a display panel comprising a plurality of gate lines, a plurality of data lines and a plurality of pixels connected to the gate lines and the data lines, the display panel configured to display an image;

a gate driver configured to output a gate signal to a gate line among the plurality of gate lines; and a data driver configured to selectively operate one of outputting a data voltage to a data line among the plurality of date lines and reading the data voltage stored in the pixel through the data line, wherein the gate driver is configured to output a read gate pulse for reading the data voltage of the pixel connected to an N-th gate line and an output gate pulse for outputting the data voltage of the pixel connected to the N-th gate line, N is a positive integer.

2. The display apparatus of claim 1, wherein the data driver comprises:

a buffer part configured to output the data voltage to the data line;

a read part configured to read the data voltage stored in the pixel through the data line; and a selecting part configured to be selectively connected to the buffer part and the read part.

3. The display apparatus of claim 2, wherein an output voltage of the read part is inputted to the buffer part.

4. The display apparatus of claim 3, wherein when a data signal is not inputted to the data driver, the data driver rewrites the data voltage read from the pixel to the pixel.

5. The display apparatus of claim 2, wherein the data driver further comprises an overdrive part configured to receive a present frame data signal from a timing controller and a previous frame data voltage from the read part and adjust the present frame data signal.

6. The display apparatus of claim 5, wherein the overdrive part comprises:

an analog to digital converter part configured to convert the previous frame data voltage into a previous frame data signal having a digital type; and an output part configured to compare the present frame data signal and the previous frame data signal and generate a present frame overdriving signal.

7. The display apparatus of claim 2, wherein a number of the read part in the data driver is substantially the same as a number of the data lines on the display panel.

8. The display apparatus of claim 1, wherein the output gate pulse is delayed by K gate lines from the read gate pulse, K is a positive integer.

9. The display apparatus of claim 1, wherein a pulse width of the gate signal is defined as (frame duration)/(2*number of the gate lines).

10. A display apparatus comprising:

a display panel comprising a plurality of gate lines, a plurality of data lines and a plurality of pixels connected to the gate lines and the data lines, the display panel configured to display an image;

a gate driver configured to output a gate signal to a gate line among the plurality of gate lines; and a data driver configured to selectively operate one of outputting a data voltage to a data line among the plurality of date lines and reading the data voltage stored in the pixel through the data line, wherein the data driver comprises:

a buffer part configured to output the data voltage to the data line;

a read part configured to read the data voltage stored in the pixel through the data line; and a selecting part configured to be selectively connected to the buffer part and the read part, and wherein the read part comprises:

a sampling part configured to sample the data voltage stored in the pixel; and a storing part configured to store the sampled data voltage.

11. The display apparatus of claim 10, wherein the sampling part comprises:

a read in switch connected to the data line;

an amplifier including a first input electrode connected to the read in switch, a second input electrode to which a reference voltage is applied and an output electrode;

a hold capacitor including a first end connected to the first input electrode of the amplifier and a second end connected to the output electrode of the amplifier; and a reset switch connected between the first end of the hold capacitor and the second end of the hold capacitor.

12. The display apparatus of claim 11, wherein the storing part comprises:

a first switch connected between the output electrode of the amplifier and a first node;

a second switch connected between the first node and an output node of the read part;

a first storing capacitor including a first end connected to the first node and a second end connected to a ground;

a third switch connected to the output electrode of the amplifier and a second node;

a fourth switch connected between the second node and the output node of the read part; and a second storing capacitor including a first end connected to the second node and a second end connected to the ground.

13. The display apparatus of claim 12, wherein the first switch and the fourth switch are substantially simultaneously turned on, and the second switch and the third switch are substantially simultaneously turned on.

14. The display apparatus of claim 13, wherein when the first switch and the fourth switch are turned on, the second switch and the third switch are turned off, and when the first switch and the fourth switch are turned off, the second switch and the third switch are turned on.

15. A method of driving a display panel, the method comprising:

outputting a gate signal to a gate line of the display panel using a gate driver; and selectively operating one of outputting a data voltage to a data line of the display panel and reading the data voltage stored in a pixel through the data line using a data driver, wherein the gate driver is configured to output a read gate pulse for reading the data voltage of the pixel connected to an N-th gate line and an output gate pulse for outputting the data voltage of the pixel connected to the N-th gate line, N is a positive integer.

16. The method of claim 15, wherein the data driver comprises:

a buffer part configured to output the data voltage to the data line;

a read part configured to read the data voltage stored in the pixel through the data line; and a selecting part configured to be selectively connected to the buffer part and the read part.

17. The method of claim 16, wherein the read part comprises:

a sampling part configured to sample the data voltage stored in the pixel; and a storing part configured to store the sampled data voltage.

18. The method of claim 16, wherein when a data signal is not inputted to the data driver from a timing controller, the data voltage read from the pixel is rewritten to the pixel.

19. The method of claim 16, wherein the outputting the data voltage to the data line comprises:

receiving a present frame data signal from a timing controller;

receiving a previous frame data voltage from the read part; and generating a prevent frame overdriving signal by adjusting the present frame data signal based on the present frame data signal and the previous frame data voltage.

* * * * *